US010315377B2

(12) United States Patent
Sireix

(10) Patent No.: US 10,315,377 B2
(45) Date of Patent: Jun. 11, 2019

(54) METHOD FOR ASSEMBLING TUBULAR BODIES MADE FROM A CARDBOARD MATERIAL WITH A SEALING STRUCTURE

(71) Applicant: Guillaume Sireix, Illzach (FR)

(72) Inventor: Guillaume Sireix, Illzach (FR)

( * ) Notice: Subject to any disclaimer, the term of this patent is extended or adjusted under 35 U.S.C. 154(b) by 753 days.

(21) Appl. No.: 14/553,245

(22) Filed: Nov. 25, 2014

(65) Prior Publication Data

US 2015/0148208 A1 May 28, 2015

(30) Foreign Application Priority Data

Nov. 27, 2013 (FR) ..... 13 61693

(51) Int. Cl.

| | |
|---|---|
| ***B31B 1/28*** | (2006.01) |
| ***B31B 1/62*** | (2006.01) |
| ***B31B 1/72*** | (2006.01) |
| ***B31B 1/90*** | (2006.01) |
| ***B31B 7/00*** | (2006.01) |
| ***B31D 1/00*** | (2017.01) |
| ***B65D 3/26*** | (2006.01) |
| ***B65B 7/16*** | (2006.01) |

(Continued)

(52) U.S. Cl.

CPC ..... *B31D 1/0018* (2013.01); *B31D 1/005* (2013.01); *B65B 7/164* (2013.01); *B65D 3/262* (2013.01); *B31B 50/44* (2017.08); *B31B 50/64* (2017.08); *B31B 50/8144* (2017.08); *B31B 2105/0022* (2017.08)

(58) Field of Classification Search

CPC ..... B31D 1/0018; B31D 1/28; B31D 1/005; B31B 1/62; B31B 1/72; B31B 1/90; B31B 7/00; B31B 2201/2654; B31B 2201/6026; B31B 2201/9071; B31B 2217/082; B65B 7/164; B65D 3/262

USPC ..... 493/93, 95

See application file for complete search history.

(56) References Cited

U.S. PATENT DOCUMENTS

| | | | | |
|---|---|---|---|---|
| 779,466 A * | 1/1905 | Comings | ..... | B65D 3/262 206/807 |
| 1,272,789 A * | 7/1918 | Ford | ..... | B21D 51/32 413/4 |

(Continued)

FOREIGN PATENT DOCUMENTS

| | | |
|---|---|---|
| FR | 2 716 408 A | 8/1995 |
| FR | 2 981 333 A | 10/2011 |

(Continued)

*Primary Examiner* — Alexander M Valvis
*Assistant Examiner* — Lucas E. A. Palmer
(74) *Attorney, Agent, or Firm* — Haug Partners LLP

(57) ABSTRACT

A method, a shaping tool and a machine for assembling a tubular cardboard body (1) and a flat sealing structure (6), forming a security membrane, surrounded by a peripheral strip, able to be folded down, that is sufficient to suitably assemble the sealing structure with the inner lateral wall of the tubular body, with a grippable tongue (7) folded down toward the central part of the sealing structure, on the face not designed for sealing, inserting the sealing structure in a shaping tool and shaping it in the form of a basin, the peripheral strip becoming orthogonal to said central part, inserting the structure in the tubular body using said shaping tool, configured for sealing said strip with the exception of an unsealed part thereof, extending over the circumference of said strip.

9 Claims, 11 Drawing Sheets

Figures 3, 4, 5:
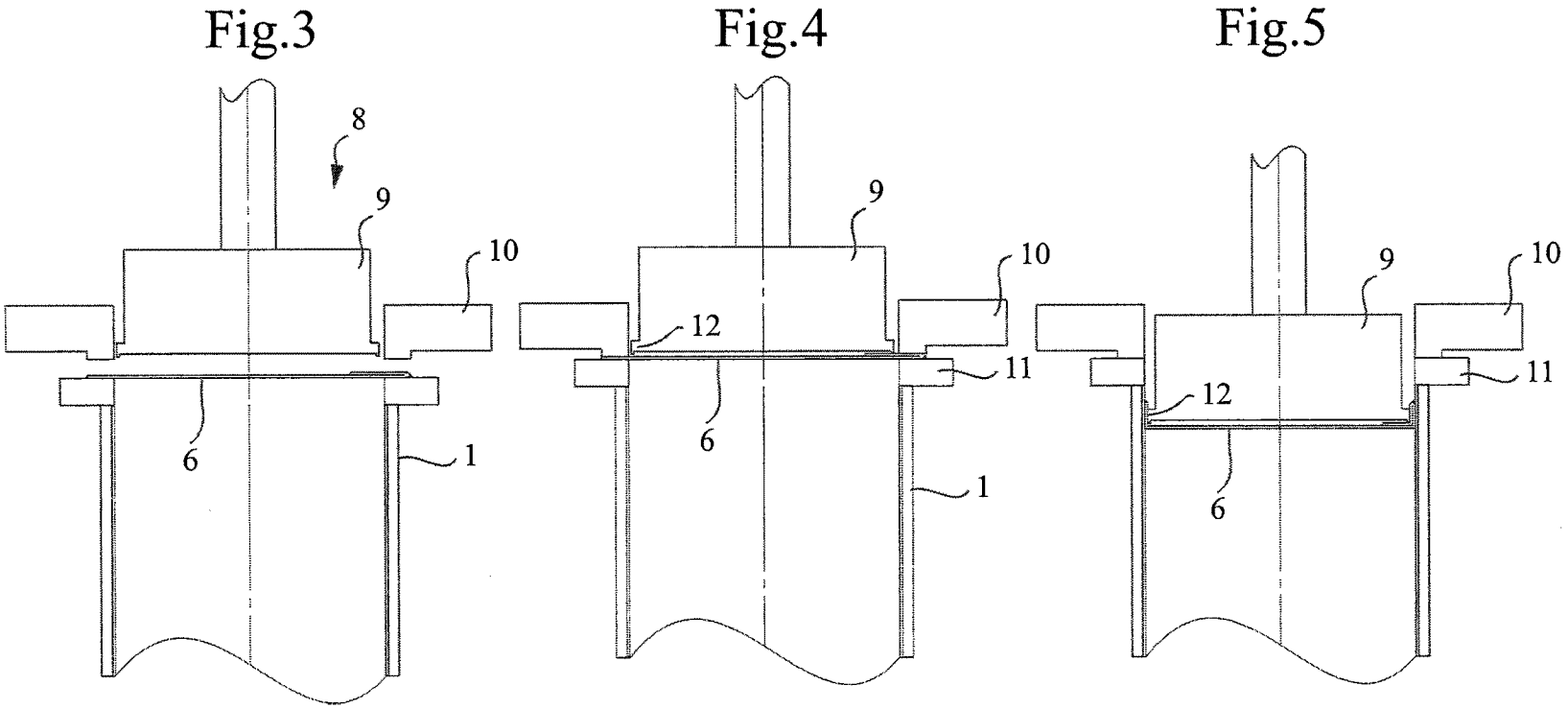

(51) Int. Cl.

| | |
|---|---|
| *B31B 50/44* | (2017.01) |
| *B31B 50/64* | (2017.01) |
| *B31B 50/81* | (2017.01) |
| *B31B 105/00* | (2017.01) |

(56) References Cited

U.S. PATENT DOCUMENTS 1,850,493 A * 3/1932 Brewer ..... B31D 1/0018 229/125.17
2,126,922 A * 8/1938 Warner ..... B31D 1/0018 162/103
2,234,457 A * 3/1941 Strovink ..... B31D 1/0018 162/127
2,969,105 A * 1/1961 Jones ..... B31D 1/0018 156/216
3,060,652 A * 10/1962 Eckman ..... B65B 7/2878 29/453
3,195,764 A * 7/1965 Fried ..... B65D 17/163 220/270
3,220,599 A * 11/1965 Fried ..... B65D 17/163 220/270
3,317,068 A * 5/1967 Betner ..... B65D 77/208 215/233
4,418,831 A * 12/1983 Schellenberg ..... B65D 43/022 220/258.2
4,556,152 A * 12/1985 Bogren ..... B65D 3/268 220/270
4,599,123 A * 7/1986 Christensson ..... B29C 65/3656 156/273.7
4,625,498 A * 12/1986 Parsons ..... B65B 7/164 156/261
4,632,298 A * 12/1986 Schellenberg ..... B65D 3/12 220/270
4,693,390 A * 9/1987 Hekal ..... B65D 77/2056 220/260
4,744,484 A * 5/1988 Grabher ..... B21D 51/44 215/253
4,846,774 A * 7/1989 Bell ..... B31D 1/0018 413/12
4,923,702 A * 5/1990 Powell ..... A47G 19/2205 206/19
5,566,529 A * 10/1996 Sireix ..... B65D 3/262 53/412
5,577,370 A * 11/1996 Pajak ..... B65B 7/164 53/329.3
5,913,798 A * 6/1999 Grabher ..... B21D 51/26 413/26
6,047,878 A * 4/2000 Lowry ..... B65D 3/262 220/258.2
6,058,682 A 5/2000 Pajak et al.
6,460,759 B1 * 10/2002 Lowry ..... B65D 3/04 229/101.2
8,424,275 B2 * 4/2013 Schneider ..... B65B 7/2878 53/287
2007/0125781 A1 * 6/2007 Schuetz ..... B21D 51/44 220/258.2
2009/0022861 A1 * 1/2009 Caunter ..... B21D 51/2653 426/131
2010/0059473 A1 * 3/2010 Kitamura ..... B31D 1/0018 215/233
2012/0184421 A1 * 7/2012 Clougherty ..... B26F 1/44 493/58
2014/0148322 A1 * 5/2014 Sireix ..... B31B 1/14 493/56

FOREIGN PATENT DOCUMENTS

FR 2 986 514 A 8/2013
FR 2 998 503 A 5/2014
WO WO 2013057392 A1 * 4/2013 ..... B31F 1/008

* cited by examiner

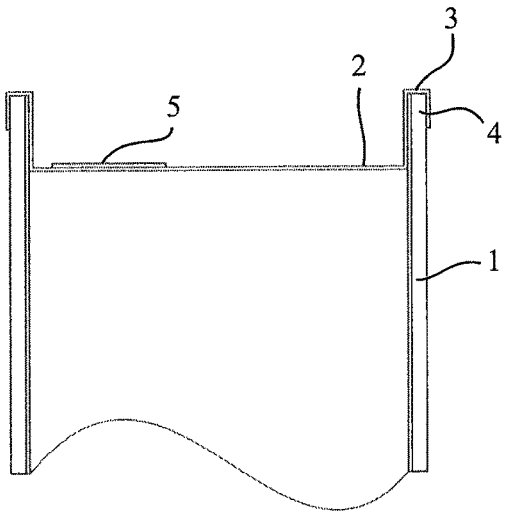
Fig.1
Fig.2
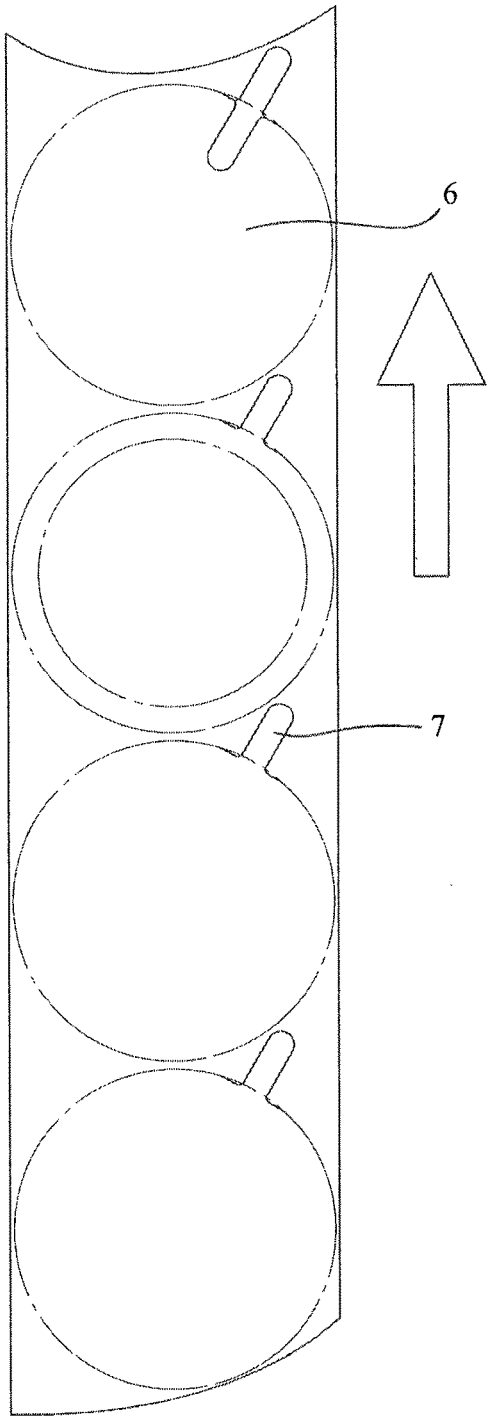

8
9
10
11
12
1
6

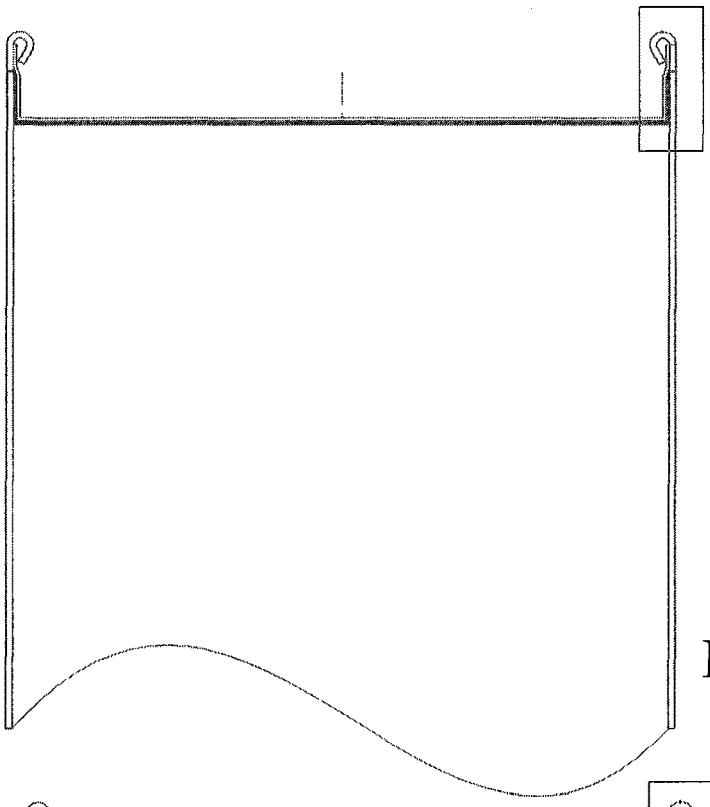
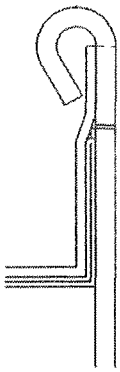
Fig.15a
Fig.15
Fig.16a
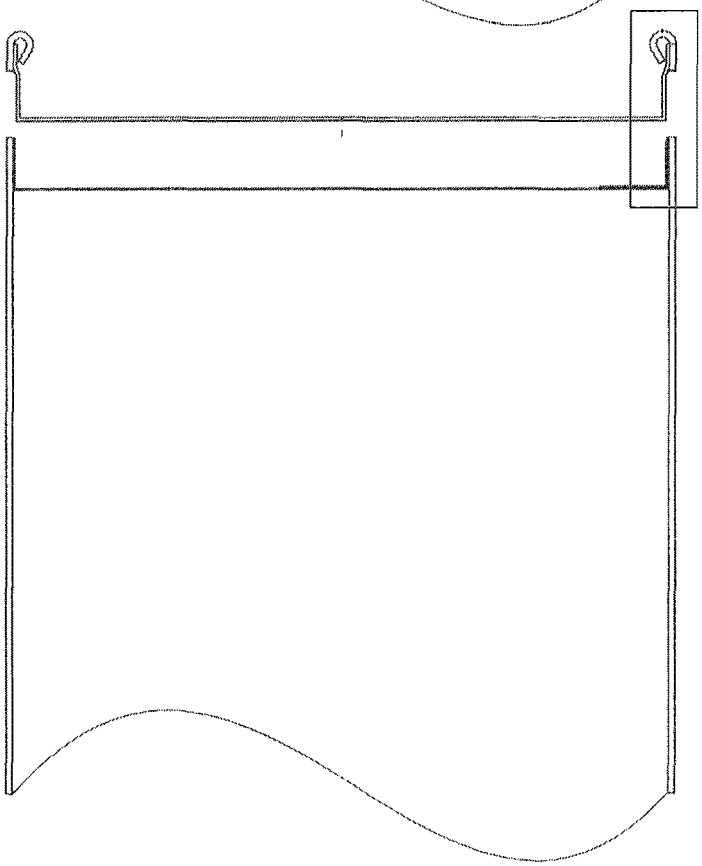
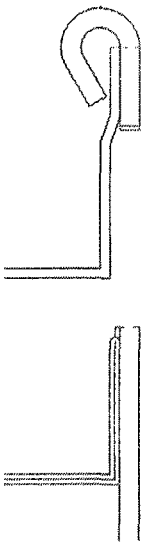
Fig.16

Fig.17
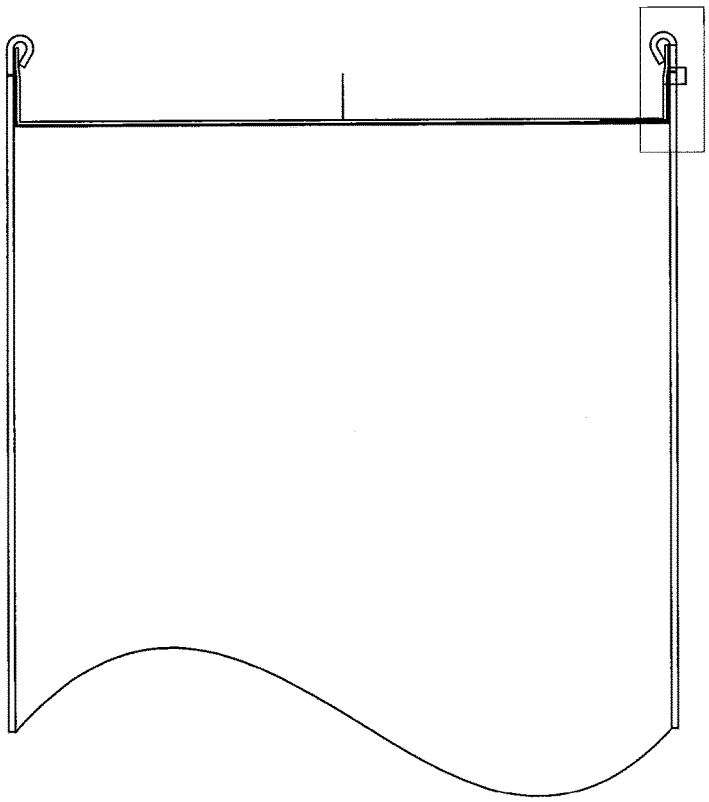
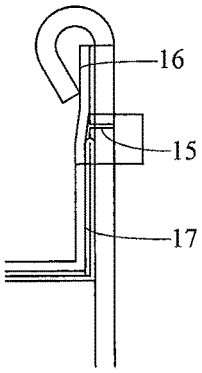
Fig.17A

Fig.18
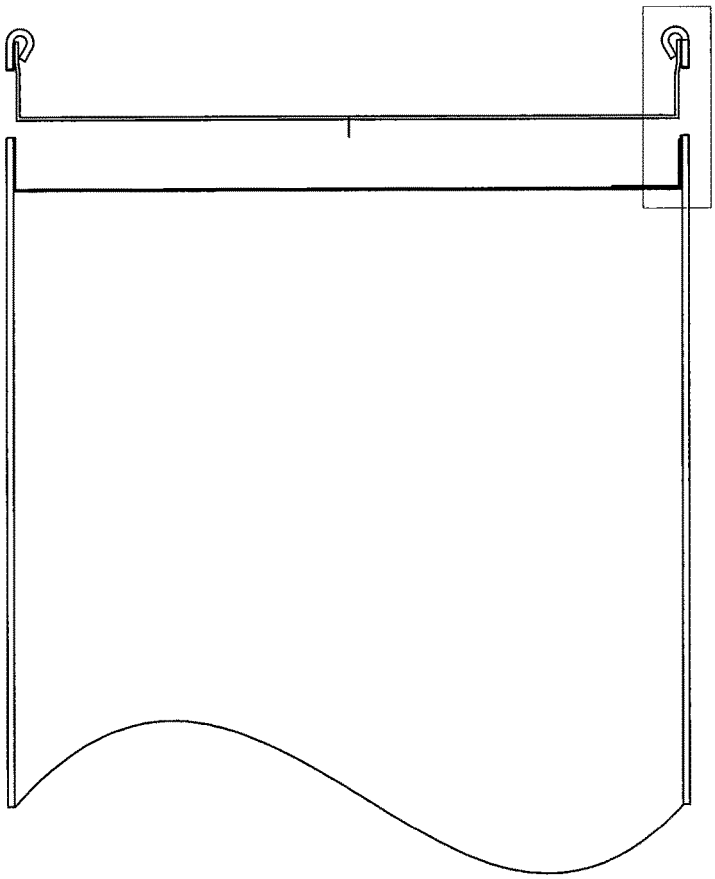
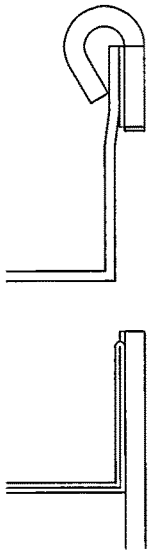
Fig.18A
Fig.19
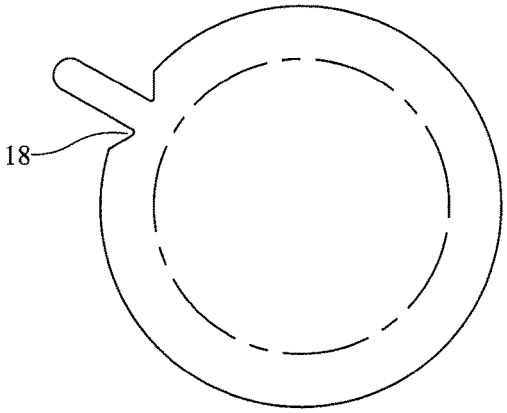
Fig.20
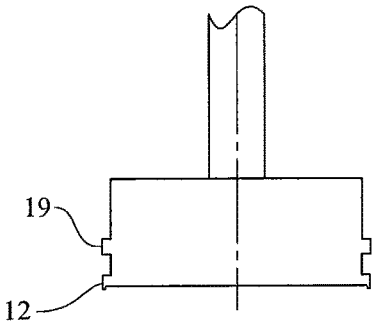

METHOD FOR ASSEMBLING TUBULAR BODIES MADE FROM A CARDBOARD MATERIAL WITH A SEALING STRUCTURE

FIELD OF THE INVENTION

The present invention relates to the field of tubular packaging, comprising a rigid tubular body, that is to say a solid limited by a cylindrical surface and two parallel planes intersecting the generatrices, made from a cardboard material, a bottom and/or a cover, as well as a security membrane, assembled to the tubular body tightly, said packagings being designed to contain solid products in divided forms, such as powders, grains, granules, fibers, chips, or products in liquid or paste form. The tubular packagings in question are also packages with a circular section and tubular packagings with a noncircular section, for example packagings with a rectangular or oval section. The tubular packagings in question are also both packagings made from cardboard strictly speaking, and packagings comprising a tubular body made from a cardboard material but with a cover and/or a bottom made from a metal material or a synthetic material.

The present invention more particularly relates to a method for manufacturing packagings comprising a tubular body made from one or more layers of cardboard material and a sealing structure, forming a security membrane for the packaging, assembled tightly to the tubular body.

BACKGROUND

The term "cardboard packaging" usually designates packagings whereof 90 to 98 wt % are made up of cellulose materials. In addition to layers of cellulose materials, this type of packaging comprises metal layers or coatings, such as aluminum, or synthetic ones, associated with cellulose materials to form a composite surface material. These metal or synthetic materials make up, according to the terminology generally accepted in the profession, a "barrier material", isolating the product stored inside the packaging from the outside environment, for example to prevent oxidation, drying, or with respect to pollutants. The synthetic layers or coatings can also play an essential role in sealing between two parts of the packaging during its manufacture; in that case, they are generally described as "reactivatable barrier material".

The French patent application by the applicant published under number FR 2,986,514 describes a method for manufacturing a packaging made substantially from cardboard, comprising a tubular body made from one or more layers of cardboard material and a complex sealing structure, assembled to the tubular body tightly, said sealing structure comprising a cover cardboard and a security membrane. This method comprises the flat assembly of three materials in sheets or strips, namely:

- a cellulose material coated with at least one reactivatable barrier material on its face oriented toward said security membrane, making up said cover cardboard;
- a laminating piece arranged between said cover cardboard and said security membrane, with a shape conjugated to the shape of the opening of the tubular body, made from paper, or coated paper, on its face oriented toward said cover cardboard, a material having sealing properties with respect to said cover cardboard, and
- a material forming said security membrane, made up of a paper coated with at least one reactivatable barrier material and the face of which not oriented toward said laminating piece can be peeled.

Patent application FR 1,261,400 by the applicant describes a method for manufacturing packagings made up of a tubular body made from a cardboard material and a complex sealing structure comprising a cover cardboard and a security membrane, as well as a machine carrying out that method, comprising

- supplying a sealing unit with preformed tubular bodies, two by two, and with sealing structures in the form of flats, two by two, each comprising a central part with a shape conjugated to the shape of the opening of the tubular bodies, surrounded by a peripheral part able to be folded down that is sufficient to tightly assemble the sealing structure with the inner lateral wall of the tubular body,
- inserting pairs of sealing structures into a shaping tool and shaping them in form of a basin;
- inserting, placing and sealing the entire folded down peripheral part of the basins in the tubular bodies using said shaping tool;
- transferring, two by two, tubular bodies assembled to the sealing structures to a finishing unit,
- pre-cutting the lateral wall of the tubular bodies and partially pre-cutting covers along a peripheral line,
- at least one operation for finishing the end of the packaging bearing said sealing structure.

The description of patent application FR 1,261,400 is incorporated into this text through this citation and by? reference.

Many materials can be considered to produce a security membrane: aluminum and sealing film(s), aluminum and sealing varnish, paper and aluminum and sealing film(s), barrier film paper (e.g., metalized PET, PET SIOX, PVDC, etc.) and sealing film(s). The materials used must be compatible for sealing with the inner wall of the tube. If a complex with paper is used, the membrane can be printed and identified by spots in order to be caught and positioned perfectly centered in the tube.

With a known technique called "recess membrane", the cut surface of the membrane is clearly much larger than the transverse surface of a given tube. During the passage from the flat state to the shaped state, folds are generated that constitute a proportionate number of wells that allow air and moisture to pass and therefore prevent good sealing of the assembly. To offset this, in the state of the art, it is necessary to use very strong materials in order to use very high pressure hold-down members, generally hydraulic. The range of usable materials is then practically limited to only aluminum with varnish. This poses cost problems, since aluminum is an expensive material, subject to considerable price variations. Furthermore, a large amount of material is necessary to perform this shaping operation, and it is therefore disadvantageous in terms of material cost and final competitiveness. The first aim of the present invention is to offer a method making it possible to use a wide range of materials to produce the security membrane.

Furthermore, in order to have easy opening, the sealing of the membrane on the tube must be easily "strippable". To that end, in general in the state of the art, an attached tongue is used fastened to the periphery of the security membrane. Here again, this limits the choice of materials both for the membrane and for the barrier of the tube itself. Here again, the material costs are not optimized. The present invention also aims to produce a membrane allowing easy and reliable opening without being restricted in the choice of materials, as in the case of the methods of the state of the art mentioned above. The invention proposes to facilitate the separation of the security membrane during the first use, while decreasing the necessary pulling force, without, however, altering the tightness of the membrane before that first use.

The French patent published under no. FR 2,716,408 describes the manufacture of a tubular packaging of the above type. The structure comprises a cover cardboard made from a cellulose material and a security membrane made from a cellulose material coated with a barrier material. These two pieces are shaped one after the other, in the form of cylindrical basins using a shaping punch through an outer die and engaged in one end of the tubular body. The lateral walls of the two pieces are tightly assembled with the inner wall of the tubular body. Then, the wall of the tubular body is precut along a peripheral line situated between the assembly zones of the two pieces, so as to allow the opening of the cover cardboard without tearing the security membrane. The drawback of this method, specifically adapted to the assembly of cellulose/cardboard materials, is its inapplicability to a wide range of materials. The present invention also aims to offset this problem. The invention also aims to produce a structure comprising a tubular body as mentioned above, provided with a security membrane, on which structure it is possible to form and/or adapt a wide range of types of covers.

SUMMARY OF THE INVENTION

The present invention proposes a method for manufacturing a packaging comprising a tubular body made from one or more layers of a cardboard material and a sealing structure, forming a security membrane, comprising

- providing a sealing structure in the form of a flat comprising a central part with a shape conjugated to the shape of the opening of the tubular body, surrounded by a peripheral strip able to be folded down that is sufficient to suitably assemble the sealing structure with the inner lateral wall of the tubular body, and a tongue integral with the rest of the sealing structure, with a sufficient size to allow gripping by a consumer, comprising a proximal end situated in said peripheral strip and the distal end extending outside said peripheral strip, said tongue being folded down toward the central part of the sealing structure, on the face not designed for sealing, in order to form said flat,
- inserting the sealing structure in a shaping tool and shaping it in the form of a basin, the peripheral strip becoming orthogonal to said central part,
- inserting and placing the tubular body at a predetermined level, and
- sealing the peripheral strip in the tubular body using said shaping tool, with the exception of an unsealed part thereof, extending over the circumference of said peripheral strip, forming the marginal zone of the sealing structure in the finished packaging.

In a first embodiment of the method according to the invention, the unsealed part is made up of a marginal zone of said peripheral strip extending over the circumference thereof.

According to a second embodiment of the method according to the invention, the unsealed part is made up of an intermediate part of said peripheral strip situated between the marginal zone thereof and the zone of the proximal peripheral strip of the central part of the sealing structure, and, after sealing of said marginal zone and said proximal zone, the method comprises a step for cutting the tubular body and the sealing structure along a circumference of the tubular body situated across from said intermediate part.

Due to this cutting operation, the aforementioned intermediate part becomes the marginal zone of the sealing structure in the finished packaging.

Preferably, the proximal end of the tongue is situated in the unsealed part of the peripheral strip and extends laterally on either side by two curves, the concave side of which is oriented toward the outside of the sealing structure.

One skilled in the art will observe that not sealing the marginal zone of the sealing structure, or the intermediate part mentioned above, decreases the sealed surface and thereby the folds that may cause a tightness flaw, and consequently opens the range of materials usable for the sealing structure. Furthermore, this creates a membrane portion without contact with the tubular body at the proximal end of the tongue, which makes the «peeling/stripping» operation easier and more reliable. Because the marginal zone, in other words the upper part of the security membrane of the finished packaging, is not glued/sealed to the tubular body, the pulling on the tongue causes the top of the membrane to deform by distributing the pulling forces of the tongue over a larger surface of the membrane, thereby facilitating the opening of the membrane.

According to one embodiment of the method according to the invention, said method is continuous, taken all round, and paced step by step; the cutting of the sealing structure from a strip, the advancement of the strip by one step, a cutting sequence of a sealing structure in the strip and an operation for folding down the tongue are made subject to the insertion of a sealing structure into a shaping tool and an assembly sequence of the materials.

According to one embodiment of the method for manufacturing a packaging as defined above, the end of the tubular body situated near said sealing structure undergoes a finishing operation determined by the choice of the cover.

The method according to the invention is implemented using a shaping tool, comprising a sealing buffer; said sealing buffer comprises a sealing base with a cross-section conjugated to the cross-section of the tubular body, the height of which is smaller than the width of the peripheral strip able to be folded down of the sealing structure, said sealing base being topped by a buffer body whereof the cross-section is chosen so as not to come into contact with said sealing structure.

According to one embodiment of the shaping tool, the sealing buffer comprises a second sealing strip with a cross-section conjugated to the cross-section of the tubular body, arranged at a distance from said sealing base determined by the width of said unsealed intermediate part.

The invention also relates to a machine for manufacturing packagings comprising a tubular body made from a cardboard material and a sealing structure, assembled to the tubular body tightly, designed to carry out the above method, said machine comprising

- the sealing unit, comprising at least one shaping tool as defined above.

According to one embodiment, the machine for manufacturing packagings comprises

- a supply device inserting tubular bodies into at least one sealing unit,
- a supply device bringing sealing structures in the form of flats in said sealing units to at least one shaping tool defined above,
- a transfer device for transferring tubular bodies, sealed to sealing structures, from the sealing unit to a finishing unit,
- a finishing unit comprising at least one finishing tool, with which each tubular body, sealed to a sealing structure, interacts to perform at least one specific finishing operation in order to adapt the end of the tubular body adjacent to the sealing structure to a predetermined type of cover.

The machines of the state of the art work at rhythms of 60-80 units, i.e., tubular bodies+membranes or covers, per minute. With the strong development of sales of cardboard boxes since 2007 and the pressure on prices exerted by the industries consuming those packagings, a demand exists to find technical solutions to produce more, faster and less expensively. The machine according to the invention may advantageously be adapted from a machine producing packagings two by two, like that described in FR 1,261,400, provided with shaping tools as defined above.

Figure 6:
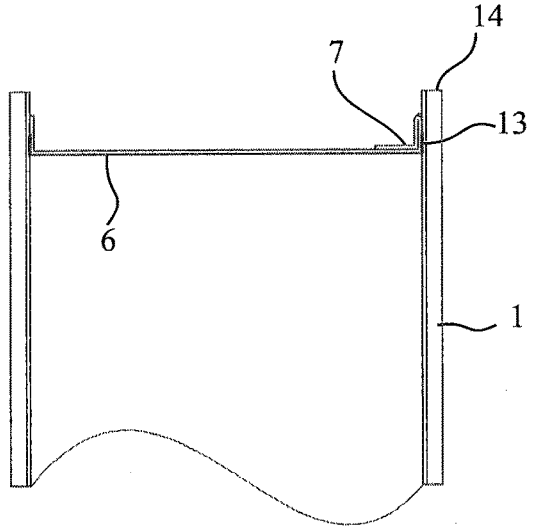
Figure 7:
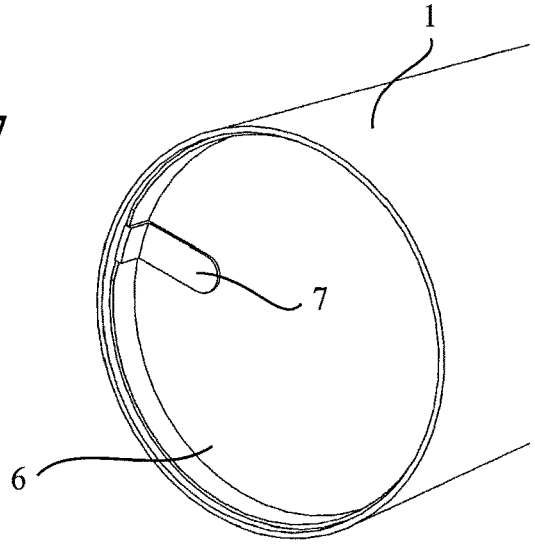
Figure 8:
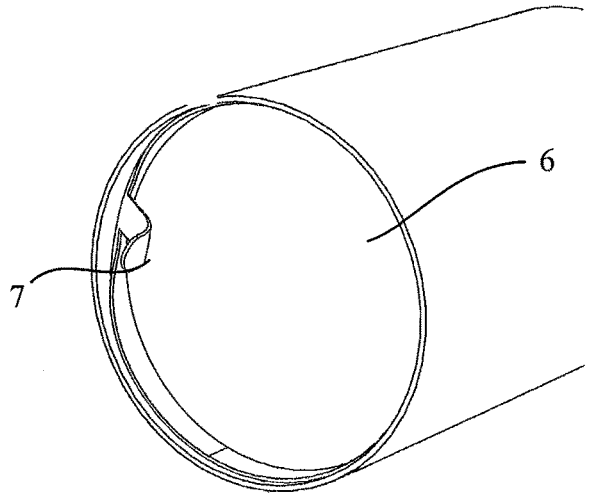
Figure 9:
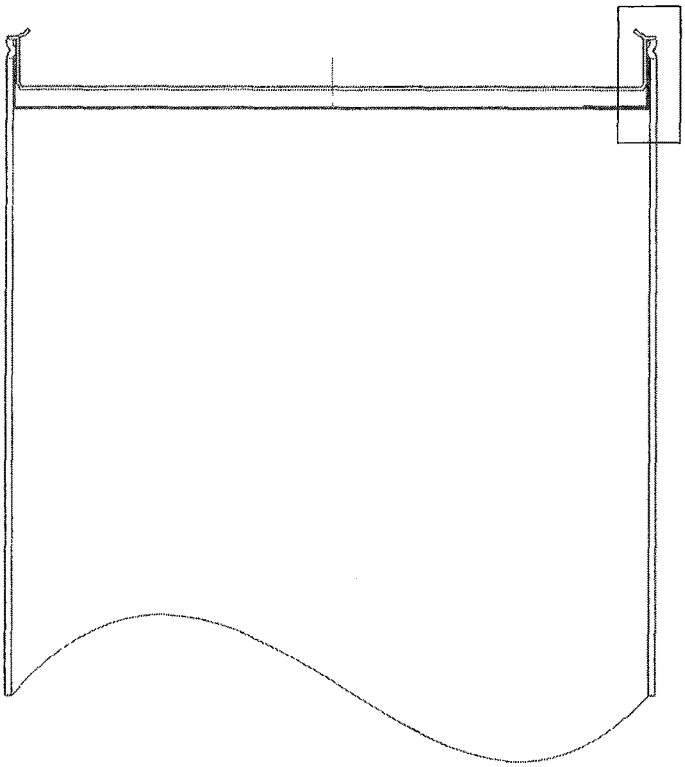
Figure 9A:
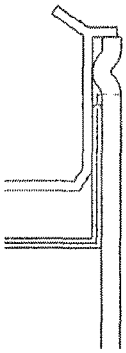
Figure 10:
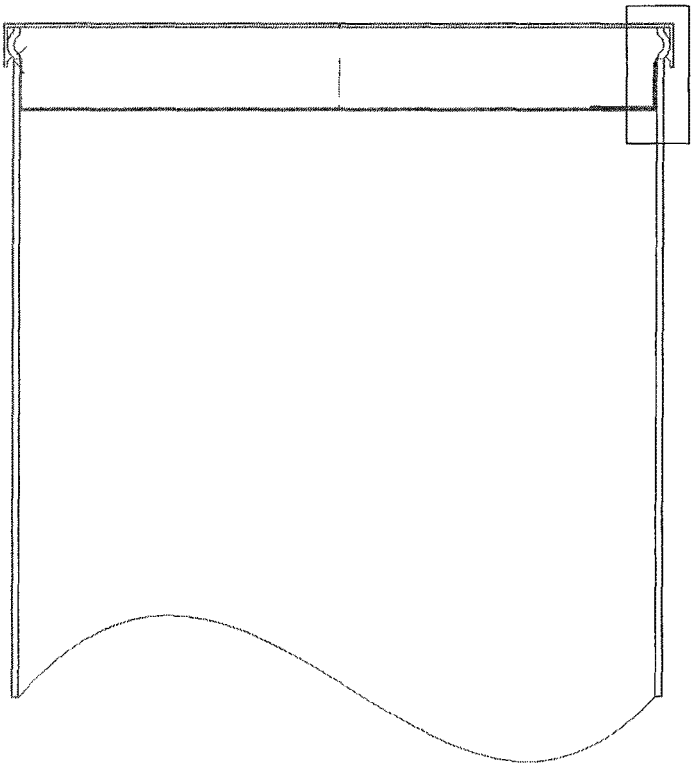
Figure 10A:
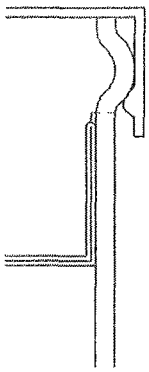
Figure 11:
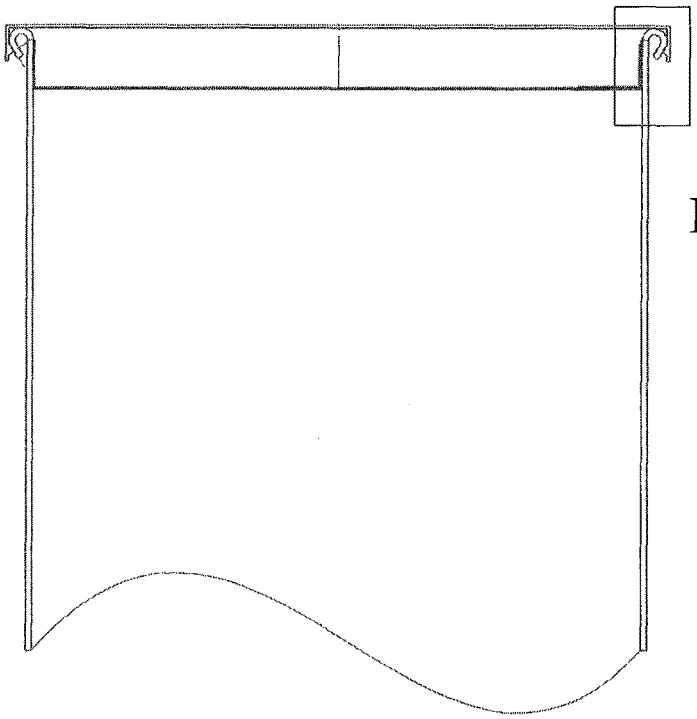
Figure 11A:
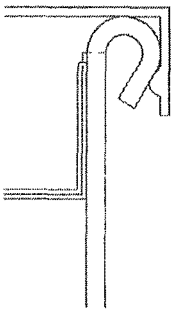
Figure 12:
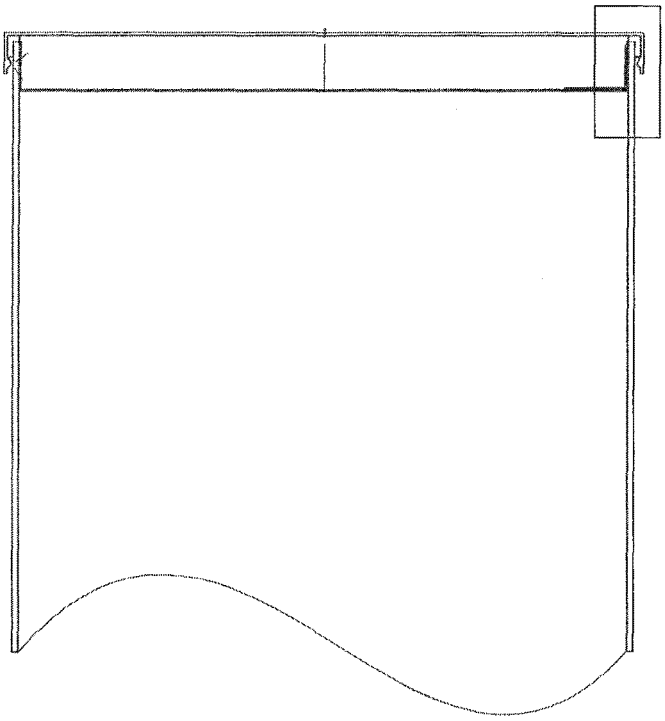
Figure 12A:
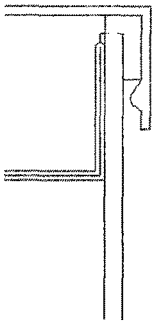
Figure 13:
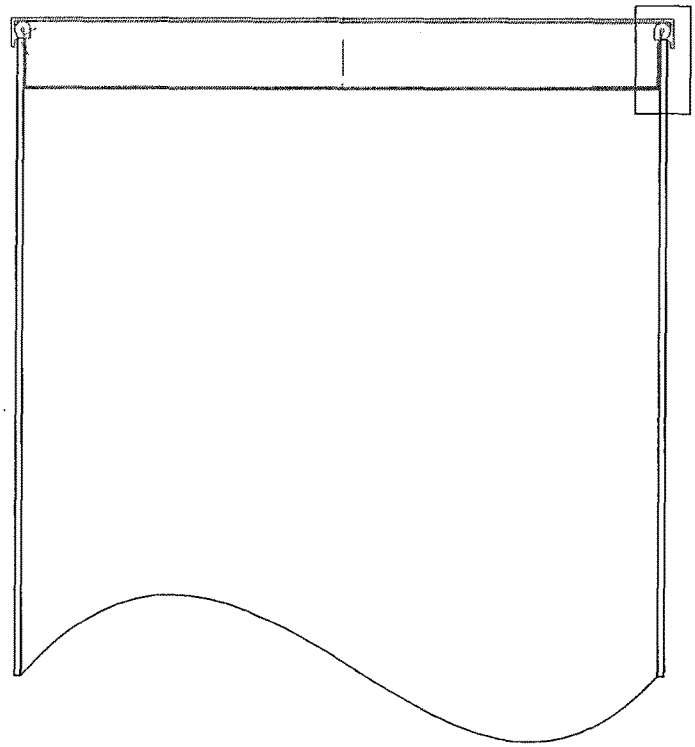
Figure 13A:
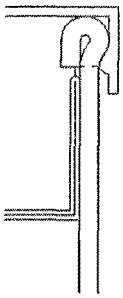
Figure 14:
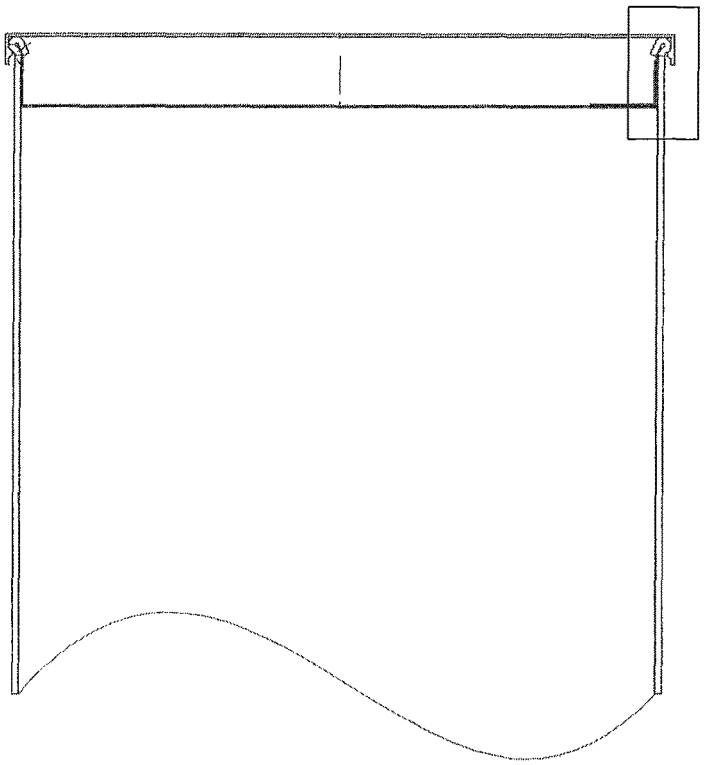
Figure 14A:
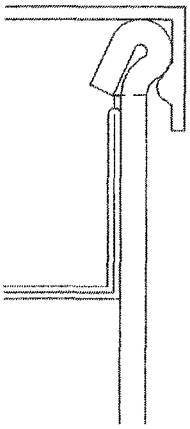
Figures 21A, 21B, 21C, 21D:
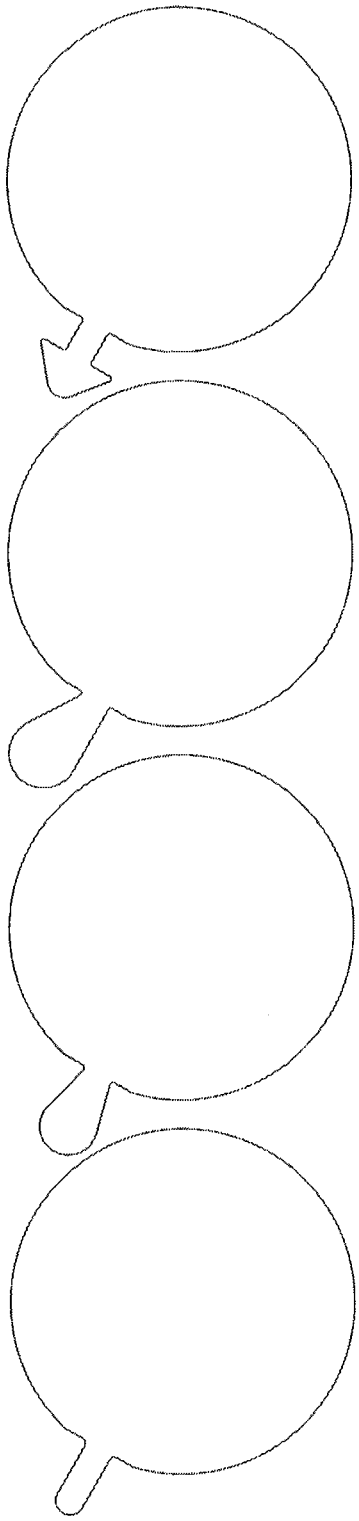

Other features and advantages of the invention will be better understood by one skilled in the art owing to the description below of one embodiment in reference to the drawing, in which:

FIG. 1 shows a tubular body associated with a security membrane according to the state of the art, FIG. 2 shows the production of a sealing structure according to the invention in the form of flats from a strip, FIG. 3 shows the insertion of a flat according to FIG. 2 into a shaping tool, FIGS. 4 and 5 show the shaping and sealing operations of the sealing structure in a tubular body, FIG. 6 is a longitudinal cross-sectional view of a sealing structure sealed in a tubular body, FIG. 7 is a perspective view of the assembly of FIG. 6, FIG. 8 shows the beginning of the operation for removal of the sealing structure by a user, FIG. 9 shows an example of finishing of the rim of the tubular body to receive a first type of cover, FIG. 9*a* being a partial enlarged view thereof, FIG. 10 shows a second example of finishing of the rim of the tubular body to receive a second type of cover, FIG. 10*a* being a partial enlarged view thereof, FIG. 11 shows a third example of the finishing of the rim of the tubular body to receive a third type of cover, FIG. 11*a* being a partial enlarged view thereof, FIG. 12 shows a fourth example of finishing of the rim of the tubular body to receive a fourth type of cover, FIG. 12*a* being a partial enlarged view thereof, FIG. 13 shows a fifth example of finishing of the rim of the tubular body to receive a fifth type of cover, FIG. 13*a* being a partial enlarged view thereof, FIG. 14 shows a sixth example of finishing of the rim of the tubular body to receive a sixth type of cover, FIG. 14*a* being a partial enlarged view thereof, FIG. 15 shows a seventh example of finishing of the rim of the tubular body to receive a seventh type of cover, with pre-cutting of the cover, FIG. 15*a* being a partial enlarged view thereof, FIG. 16 shows the detachment of the cover of FIG. 15, FIG. 16*a* being a partial enlarged view thereof, FIG. 17 shows an eighth example of finishing of the rim of the tubular body to receive an eighth type of cover, with pre-cutting of the cover and the membrane, FIG. 17*a* being a partial enlarged view thereof, FIG. 18 shows the detachment of the cover of FIG. 17, FIG. 18*a* being a partial enlarged view thereof, FIG. 19 shows a flat sealing structure for producing the assembly of FIGS. 17 and 17*a*, FIG. 20 is a diagrammatic axial cross-sectional view of a sealing buffer for producing the assembly of FIGS. 17 and 17*a*, FIGS. 21*a*, 21*b*, 21*c* and 21*d* show alternative embodiments of sealing structures, flat.

Figure 22:
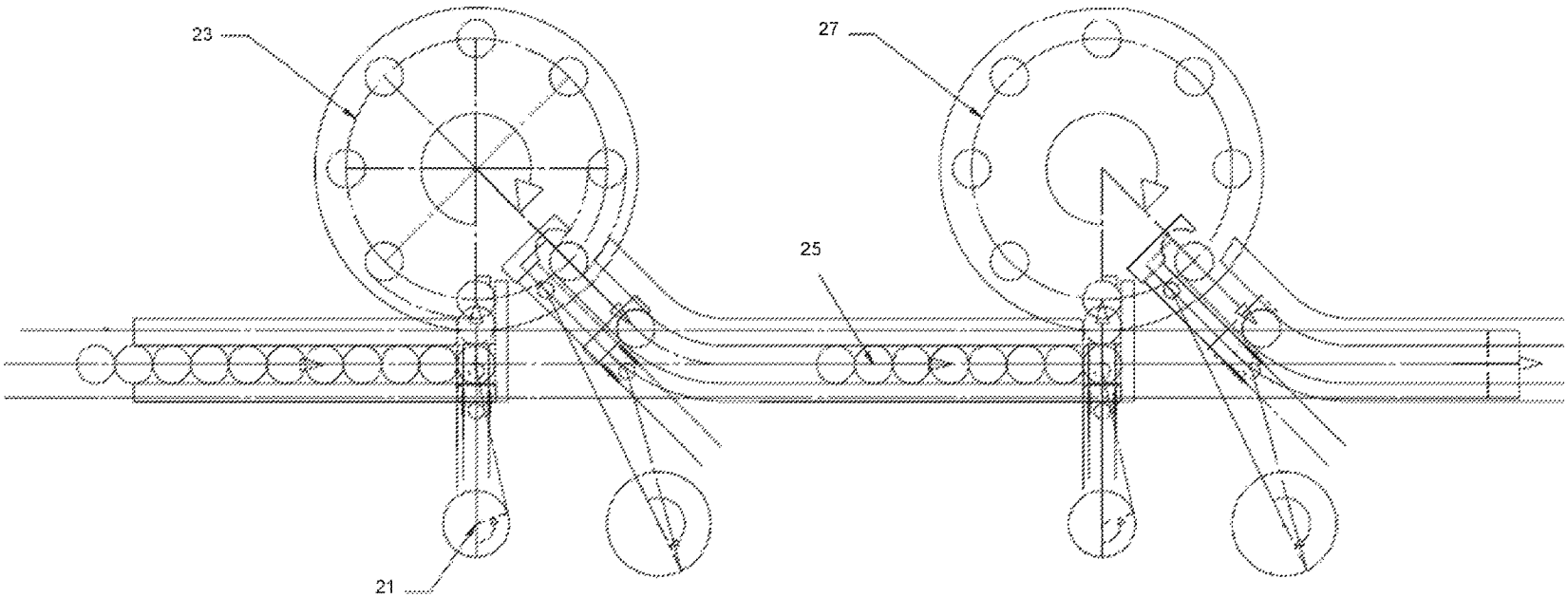

FIG. 22 shows an embodiment depicting the production the tubular bodies with the sealing structures

DETAILED DESCRIPTION OF PREFERRED EMBODIMENTS

FIG. 1 shows a tubular body 1 associated with a security membrane 2 of the "recess-membrane" type whereof the peripheral part 3 covers the rim 4 of the tubular body 1. In the structure of the state of the art, the peripheral part 3 houses many flaws, which are sources of tightness defects. A tongue 5 is glued or sealed on the security membrane 2. This construction requires additional material and complex operations on the membrane.

FIG. 2 shows the production of a security membrane 6 according to the invention, by stamping, from a strip of membrane material advancing under the stamping tool. At the top of FIG. 2, one sees the tongue 7, integral with the rest of the membrane, folded toward the center thereof to form a flat. In the embodiment shown by FIG. 2, on either side of the base of the tongue 7, the periphery of the membrane has two small concave zones in order to facilitate the subsequent detachment of the membrane from the inner wall of the tubular body. FIGS. 21*a*, 21*b*, 21*c* and 21*d* show alternative embodiments of sealing structures, flat. One skilled in the art will note that although the shapes of the tongues differ from the tongue 7 of FIG. 2, the proximal end extends laterally on either side by two slight curves, the concave side of which is oriented toward the outside of the sealing structure.

FIG. 3 shows the membrane 6, still in flat form, inserted into a shaping tool 8 whereof the overall structure and the operating mode are known in the state of the art. FIG. 4 shows the descent of the sealing buffer 9 and the pinching of hold-down members 10 and the shaping die 11. FIG. 5 shows the security membrane 6 formed into a basin, the tongue 7 being folded down at a right angle by the sealing buffer 9. One skilled in the art will see, in light of FIGS. 4 and 5, that only the base 12 of the sealing buffer 9 interacts on its perimeter with the membrane 6, the upper part of the sealing buffer being withdrawn, optionally covered by a thermally insulating layer. Likewise, the sealing buffer preferably has, in its lower part, a zone thermally insulated by a protector so as not to adhere to the tongue, by activation effect, on the sealing part of the tongue when the buffer is removed.

With the configuration described above, it is possible to tightly grip the shaping die and thus concentrate the folds/overthicknesses toward the unsealed marginal zone of the membrane, while improving the membrane/tubular body tightness, while also avoiding moving the membrane by friction effect during that removal of the buffer.

FIG. 6 and FIG. 7 show the outcome of the operation: only the zone 13 of the peripheral strip of the membrane 6 embodied by an extra thick line is sealed to the tubular body 1. The tongue 7 and the marginal zone of the membrane 6 are not secured to the tubular body 1. The marginal zone not sealed [can] in particular have a width from 1 to 3 mm. FIG. 8 shows the beginning of an operation for detaching the membrane 6 by a user who grasps the tongue 7. The pulling on the tongue 7 is distributed on either side of the base thereof owing to the marginal zone, which has remained free. The concave side of the marginal zones bordering the base of the tongue shown in particular in FIG. 2 contributes to this distribution.

One skilled in the art will in particular see, in light of FIG. 6, that the security membrane is positioned according to the invention at a certain distance from the rim 14 of the tubular body, at a depth chosen by the manufacturer of the packaging based on the cover designed for that packaging. This distance makes it possible to perform a finishing operation of the rim, which, in the majority of cases, does not affect the membrane, but may nevertheless encompass it.

One skilled in the art will also see that many materials, like those cited above, are usable to produce the membrane, the only condition being compatibility with the inner barrier material of the tubular body regarding the heat sealing.

FIGS. 9-16 show a plurality of non-limiting examples of such finishing operations by grooving or hemming:

FIGS. 9 and 9*a* show grooving for an inward cover,

FIGS. 10 and 10*a* show grooving for a cover with an outer engagement (clipped cover), FIGS. 11 and 11*a* show hemming for a cover with an outer engagement, FIGS. 12 and 12*a* show the placement of an insert between the right edge of the tubular body and a cover with outer gripping, FIGS. 13 and 13*a* show a second hemming for a cover with outer engagement, FIGS. 14 and 14*a* show a third hemming for a cover with outer engagement, FIGS. 15 and 15*a* show a fourth hemming of the rim of the tubular body covering the edge of an inward cover, with a precut of the tubular body near that hemming, without emerging in the cover itself, making it possible, as shown by FIGS. 16 and 16*a*, to have an easy separation of the cover without affecting the safety membrane, as well as re-closing of the packaging after tearing away the membrane.

FIG. 19 shows an embodiment of the sealing structure in which the peripheral strip, symbolized by the circle in dotted lines, is wider than in the embodiment shown in FIG. 2 and the concave cutting zones 18 on either side of the tongue are deeper. The sealing buffer designed to place that sealing structure in the tool body has, in addition to the sealing base 12 of the embodiment shown by FIGS. 3-5, a second sealing strip 19 arranged at a distance from the sealing base determined by the width of the intermediate part of the peripheral strip of the sealing structure designed not to be sealed. The result of the operation is in particular shown in FIG. 17*a*. The peripheral strip is sealed to the body in its upper marginal zone 16 and in its lower zone 17, leaving the intermediate zone free, at which a cutout 15 is formed on the circumference of the tubular body, in a finishing operation that follows the hemming operation of the upper rim of the tubular body. FIGS. 18 and 18*a* show the detachment of the cover from the structure shown in FIGS. 17 and 17*a*. One skilled in the art will note that during the detachment of the cover, the initial marginal zone of the sealing structure is detached therefrom and remains secured to the cover while the intermediate part, with which the proximal part of the tongue is secured, becomes the new upper marginal zone of the security membrane.

FIG. 22 shows an embodiment depicting the production of tubular bodies 1 with security membranes 6. On the left side of FIG. 22, supply device 21 inserts tubular bodies 1 into at least one sealing unit. Each sealing unit comprises at least one shaping tool comprising a sealing buffer, wherein said sealing buffer comprises a sealing base with a cross-section conjugated to the cross-section of the tubular body, the height of which is smaller than the width of the peripheral strip able to be folded down of the sealing structure, said sealing base being topped by a buffer body whereof the cross-section is chosen so as not to come into contact with said sealing structure. Supplying device 23 brings the sealing structures 6 in the form of flats in said sealing units to at least one shaping tool 8 wherein the proximal end of the tongue is situated in the unsealed part of the peripheral strip and extends laterally on either side by two curves, the concave side of which is oriented toward the outside of the sealing structure. Transfer device 25 transfers tubular bodies 1, sealed to sealing structures 6, from the sealing unit to a finishing unit 27. Finishing unit 27 comprising at least one finishing tool, with which each tubular body, sealed to a sealing structure, interacts to perform at least one specific finishing operation in order to adapt the end of the tubular body adjacent to the sealing structure to a predetermined type of cover.

The variety of the examples above shows that the assembly of a security membrane and a tubular body according to the invention offers a certain universality regarding the choice of adaptable covers, as well as regarding the shape of the covers and their materials, and therefore a wide range of applications.

What is claimed is:

1. A method for manufacturing a packaging comprising a tubular body made from one or more layers of a cardboard material and a sealing structure, the method comprising forming a security membrane, comprising:

providing the sealing structure in the form of a flat membrane comprising:

a central part with a shape conjugated to the shape of the opening of the tubular body, surrounded by a peripheral strip able to be folded down that is sufficient to suitably assemble the sealing structure with an inner lateral wall of the tubular body, and a tongue integral with the rest of the sealing structure, with a sufficient size to allow gripping by a consumer, comprising a proximal end situated in said peripheral strip and a distal end extending outside said peripheral strip, said tongue being folded down toward the central part of the sealing structure, on a face not designed for sealing, in order to form said flat membrane, inserting the sealing structure in a shaping tool and shaping it in the form of a basin, the peripheral strip becoming orthogonal to said central part, inserting and placing the tubular body at a predetermined level, and circumferentially sealing the peripheral strip in the tubular body using said shaping tool, with the exception of an unsealed part thereof, forming a marginal zone of the sealing structure in the packaging, wherein the proximal end of the tongue is situated in the unsealed part of the peripheral strip, and wherein the unsealed part of the peripheral strip extends over the circumference of the peripheral strip and over a certain width of the peripheral strip, creating a portion of the peripheral strip that does not contact the tubular body at the proximal end of the tongue, wherein the portion of the peripheral strip is located at the proximal end of the tongue and pulling on the tongue causes the top of the flat membrane to deform by distributing the pulling forces of the tongue over a surface of the sealed part of the membrane.

2. The method according to claim 1, wherein the unsealed part is made up of an intermediate part of said peripheral strip situated between the marginal zone thereof and a zone of the proximal peripheral strip of the central part of the sealing structure, and, after sealing of said marginal zone and said proximal zone, wherein the step of performing a cutting operation further comprises cutting the sealing structure along a circumference of the tubular body situated across from said intermediate part.

3. The method according to claim 1, wherein the proximal end of the tongue extends laterally on either side by two curves, the concave side of which is oriented toward the outside of the sealing structure.

4. The method according to claim 1, wherein said method is continuous and paced step by step; wherein the cutting of the sealing structure from a strip, the advancement of the strip by one step, a cutting sequence of the sealing structure in the strip and an operation for folding down the tongue are made subject to the insertion of the sealing structure into the shaping tool and an assembly sequence of the materials.

5. The method according to claim 1, wherein the end of the tubular body situated near said sealing structure undergoes a finishing operation determined by the choice of the cover.

6. A shaping tool for carrying out a method according to claim 1, comprising a sealing buffer, wherein said sealing buffer comprises a sealing base with a cross-section conjugated to the cross-section of the tubular body, the height of which is smaller than the width of the peripheral strip able to be folded down of the sealing structure, said sealing base being topped by a buffer body whereof the cross-section is chosen so as not to come into contact with said sealing structure.

7. The shaping tool according to claim 6, intended to carry out a method wherein the unsealed part is made up of an intermediate part of said peripheral strip situated between the marginal zone thereof and the zone of the proximal peripheral strip of the central part of the sealing structure, and, after sealing of said marginal zone and said proximal zone, the method comprises a step for cutting the tubular body and the sealing structure along a circumference of the tubular body situated across from said intermediate part, wherein the sealing buffer comprises a second sealing strip with a cross-section conjugated to the cross-section of the tubular body, arranged at a distance from said sealing base determined by the width of said unsealed intermediate part.

8. A machine for manufacturing packagings comprising a tubular body made from a cardboard material and a sealing structure, assembled to the tubular body tightly, designed to carry out the method according to claim 1, said machine comprising a sealing unit, comprising at least one shaping tool comprising a sealing buffer, wherein said sealing buffer comprises a sealing base with a cross-section conjugated to the cross-section of the tubular body, the height of which is smaller than the width of the peripheral strip able to be folded down of the sealing structure, said sealing base being topped by a buffer body whereof the cross-section is chosen so as not to come into contact with said sealing structure.

9. The machine for manufacturing packagings according to claim 8, comprising a supply device inserting tubular bodies into at least one sealing unit, a supply device bringing sealing structures in the form of flats in said sealing units to at least one shaping tool wherein the proximal end of the tongue is situated in the unsealed part of the peripheral strip and extends laterally on either side by two curves, the concave side of which is oriented toward the outside of the sealing structure, a transfer device for transferring tubular bodies, sealed to sealing structures, from the sealing unit to a finishing unit, a finishing unit comprising at least one finishing tool, with which each tubular body, sealed to a sealing structure, interacts to perform at least one specific finishing operation in order to adapt the end of the tubular body adjacent to the sealing structure to a predetermined type of cover.

* * * * *